US009650822B2

(12) United States Patent
Bernhagen et al.

(10) Patent No.: US 9,650,822 B2
(45) Date of Patent: May 16, 2017

(54) FENESTRATION UNIT WITH SASH RETENTION

(71) Applicant: Pella Corporation, Pella, IA (US)

(72) Inventors: Todd A. Bernhagen, Pella, IA (US); Scot C. Miller, Pella, IA (US)

(73) Assignee: Pella Corporation, Pella, IA (US)

( * ) Notice: Subject to any disclaimer, the term of this patent is extended or adjusted under 35 U.S.C. 154(b) by 0 days.

(21) Appl. No.: 14/216,137

(22) Filed: Mar. 17, 2014

(65) Prior Publication Data

US 2014/0259944 A1 Sep. 18, 2014

Related U.S. Application Data

(60) Provisional application No. 61/790,269, filed on Mar. 15, 2013.

(51) Int. Cl.

| | |
|---|---|
| ***E05F 13/00*** | (2006.01) |
| ***E05D 13/00*** | (2006.01) |
| ***E05D 15/18*** | (2006.01) |
| *E05F 17/00* | (2006.01) |
| *E06B 1/62* | (2006.01) |
| *E06B 3/44* | (2006.01) |

(52) U.S. Cl.

CPC ..... *E05D 13/10* (2013.01); *E05D 13/12* (2013.01); *E05D 15/18* (2013.01); *E05F 17/00* (2013.01); *E05F 2017/005* (2013.01); *E05Y 2900/148* (2013.01); *E06B 2001/628* (2013.01); *E06B 2003/4461* (2013.01); *E06B 2003/4476* (2013.01)

(58) Field of Classification Search

USPC ..... 49/183, 184, 449, 445, 447, 448, 414, 49/415, 416, 417, 418, 419, 420, 421, 49/422

See application file for complete search history.

(56) References Cited

U.S. PATENT DOCUMENTS

| | | | | | |
|---|---|---|---|---|---|
| 141,178 | A | * | 7/1873 | Sprague | 49/449 |
| 454,349 | A | | 6/1891 | Hartman | |
| 524,608 | A | | 8/1894 | Parker et al. | |
| 590,645 | A | * | 9/1897 | Gibson | 49/438 |
| 852,147 | A | | 4/1907 | Tidd et al. | |
| 1,261,274 | A | * | 4/1918 | Newsam | 292/63 |
| 1,553,939 | A | | 9/1925 | Jacobs | |
| 1,610,435 | A | * | 12/1926 | Foote | 49/428 |
| 1,760,226 | A | * | 5/1930 | Appleby | E05D 13/08 16/193 |
| 1,965,250 | A | * | 7/1934 | Muller | 49/184 |
| 1,991,840 | A | * | 2/1935 | Burns | 49/155 |
| 2,574,742 | A | | 11/1951 | Augustine | |
| 2,791,796 | A | * | 5/1957 | Haas | E05D 13/003 16/197 |
| 2,800,687 | A | * | 7/1957 | Robichau | 49/437 |

(Continued)

*Primary Examiner* — Jerry Redman
*Assistant Examiner* — Catherine A Kelly
(74) *Attorney, Agent, or Firm* — Faegre Baker Daniels LLP

(57) ABSTRACT

A fenestration unit, such as a window, having an upper sash and a lower sash can be configured to permit separate and independent movement of the upper sash and the lower sash when desired, while restraining the upper sash from movement caused by movement of the lower sash. A fenestration unit having a single movable sash can also be configured to provide securement of the single movable sash against undesired vertical movement.

15 Claims, 9 Drawing Sheets

(56) References Cited

U.S. PATENT DOCUMENTS 2,828,513 A 4/1958 Nardulli
2,828,514 A 4/1958 Nardulli
2,856,648 A 10/1958 Haas
2,874,421 A 2/1959 Nardulli
2,879,537 A * 3/1959 Pullum ..... E05D 13/04 16/202
3,012,292 A 12/1961 Brengman
3,133,323 A * 5/1964 Robards ..... 49/174
3,145,433 A * 8/1964 Jones ..... E06B 3/26347 49/414
3,284,954 A * 11/1966 Hayman ..... E06B 3/44 49/423
3,375,610 A * 4/1968 Beasley, Jr. ..... E05D 13/1207 49/445
3,466,806 A * 9/1969 Bruyn ..... E05D 13/1207 49/430
3,524,282 A * 8/1970 Kraft ..... E06B 3/44 49/181
4,290,231 A * 9/1981 Blair ..... 49/173
4,570,382 A 2/1986 Suess
4,779,380 A * 10/1988 Westfall ..... E05D 13/1207 49/430
5,014,466 A * 5/1991 Winner ..... 49/504
5,210,976 A * 5/1993 Cripps ..... E05D 13/1276 49/181
5,428,924 A * 7/1995 Pifer ..... 49/50
5,636,475 A * 6/1997 Nidelkoff ..... 49/178
5,873,199 A * 2/1999 Meunier ..... E05D 13/1207 49/176
6,041,550 A * 3/2000 Tix ..... E05D 13/1207 49/404
6,119,398 A 9/2000 Yates et al.
6,622,342 B1 * 9/2003 Annes ..... E05D 13/08 16/193
6,802,156 B2 * 10/2004 Sherrett ..... E06B 3/44 49/181
6,840,011 B2 * 1/2005 Thompson ..... E05D 13/08 49/181
6,886,295 B2 * 5/2005 Annes ..... E05D 13/08 49/181
6,892,494 B2 * 5/2005 Malek ..... E05D 15/22 49/181
6,938,373 B2 * 9/2005 Wong ..... E05D 15/22 49/181
6,983,513 B2 1/2006 Pettit
7,013,529 B2 * 3/2006 Pettit ..... E05D 13/1207 16/193
7,367,162 B2 * 5/2008 Lucci ..... E05D 13/10 49/445
7,533,496 B2 5/2009 Tremble et al.
8,464,466 B1 * 6/2013 Kunz ..... E05D 13/1276 16/193
8,505,242 B1 * 8/2013 Kunz ..... E05D 13/1276 16/197
9,003,710 B2 * 4/2015 Kellum, III ..... E05D 13/1276 16/193
2005/0016065 A1 * 1/2005 Braid ..... E05D 13/08 49/181
2005/0229492 A1 * 10/2005 Robertson ..... E05D 13/10 49/181
2006/0230683 A1 * 10/2006 Hung ..... E05F 1/16 49/409
2009/0094898 A1 4/2009 Baker et al.
2010/0115854 A1 5/2010 Uken et al.

* cited by examiner

FENESTRATION UNIT WITH SASH RETENTION

CROSS-REFERENCE TO RELATED APPLICATION

This application claims priority to Provisional Application No. 61/790,269, filed Mar. 15, 2013, which is incorporated herein by reference in its entirety.

TECHNICAL FIELD

The invention relates generally to fenestration units and more particularly to fenestration units providing sash retention.

BACKGROUND

A number of fenestration units, such as windows, have one or more movable sashes. Some windows, known as single hung windows, have one movable sash and one stationary sash. Some windows, known as double hung windows, have two movable sashes. A first sash can generally be considered as being a lower sash while a second sash can generally be considered as being an upper sash. The lower sash and the upper sash can be movable relative to each other.

In some instances, an individual may want to raise or lower one sash, such as the lower sash, without moving the upper sash. However, in some cases movement of the lower sash can cause the upper sash to move downward.

SUMMARY

Some aspects of the invention pertain to a fenestration unit, such as a window, that is configured to permit separate and independent movement of the upper sash and the lower sash when desired, while restraining the upper sash from movement caused by movement of the lower sash.

In some embodiments, a fenestration unit includes a frame having a first side member and a first track disposed within the first side member, and a second side member and a second side track disposed within the second side member. A first counterbalance mechanism is disposed proximate the first side member and a second counterbalance mechanism is disposed proximate the second side member. A first slide member is slidably disposed within the first track and is operably connected to the first counterbalance mechanism. A second slide member is slidably disposed within the second track and is operably connected to the second counterbalance mechanism. A sash is secured to the first slide member and the second slide member such that the sash is configured to move vertically relative to the frame. A first resilient detent is secured to either the first track or the second track such that the first resilient detent interacts with either the first slide member or the second slide member when the sash is in a closed position.

In some embodiments, a fenestration frame assembly has a first side member and a second side member. A first track and a first counterbalance channel extend within the first side member. A second track and a second counterbalance channel extend within the second side member. A first counterbalance mechanism is disposed within the first counterbalance channel and a second counterbalance mechanism is disposed within the second counterbalance channel. A first slide member is slidably disposed within the first track and is operably connected to the first counterbalance mechanism. A second slide member is slidingly disposed within the second track and is operably connected to the second counterbalance mechanism. A first resilient detent is secured to the first track such that the first resilient detent is configured to interact with the first slide member as the first slide member contacts the first resilient detent. A second resilient detent is secured to the second track such that the second resilient detent is configured to interact with the second slide member as the second slide member contacts the second resilient detent.

In some embodiments, to a fenestration unit having a frame that includes a first side member and a second side member. A first slide member is slidingly disposed relative to the first side member and a second slide member is slidingly disposed relative to the second side member. A sash is disposed within the frame and is secured to the first slide member and the second slide member. A first counterbalance apparatus is configured to provide counterbalance to the sash and is disposed proximate the first side member. A second counterbalance apparatus is configured to provide counterbalance to the sash and is disposed proximate the second side member. The fenestration unit includes first retention means for retaining the sash in an upper position, the first retention means disposed proximate the first track, and second retention means for retaining the sash in an upper position, the second retention means disposed proximate the second track. The first slide member engages the first retention means and the second slide member engages the second retention means when the sash is lifted into a raised position.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
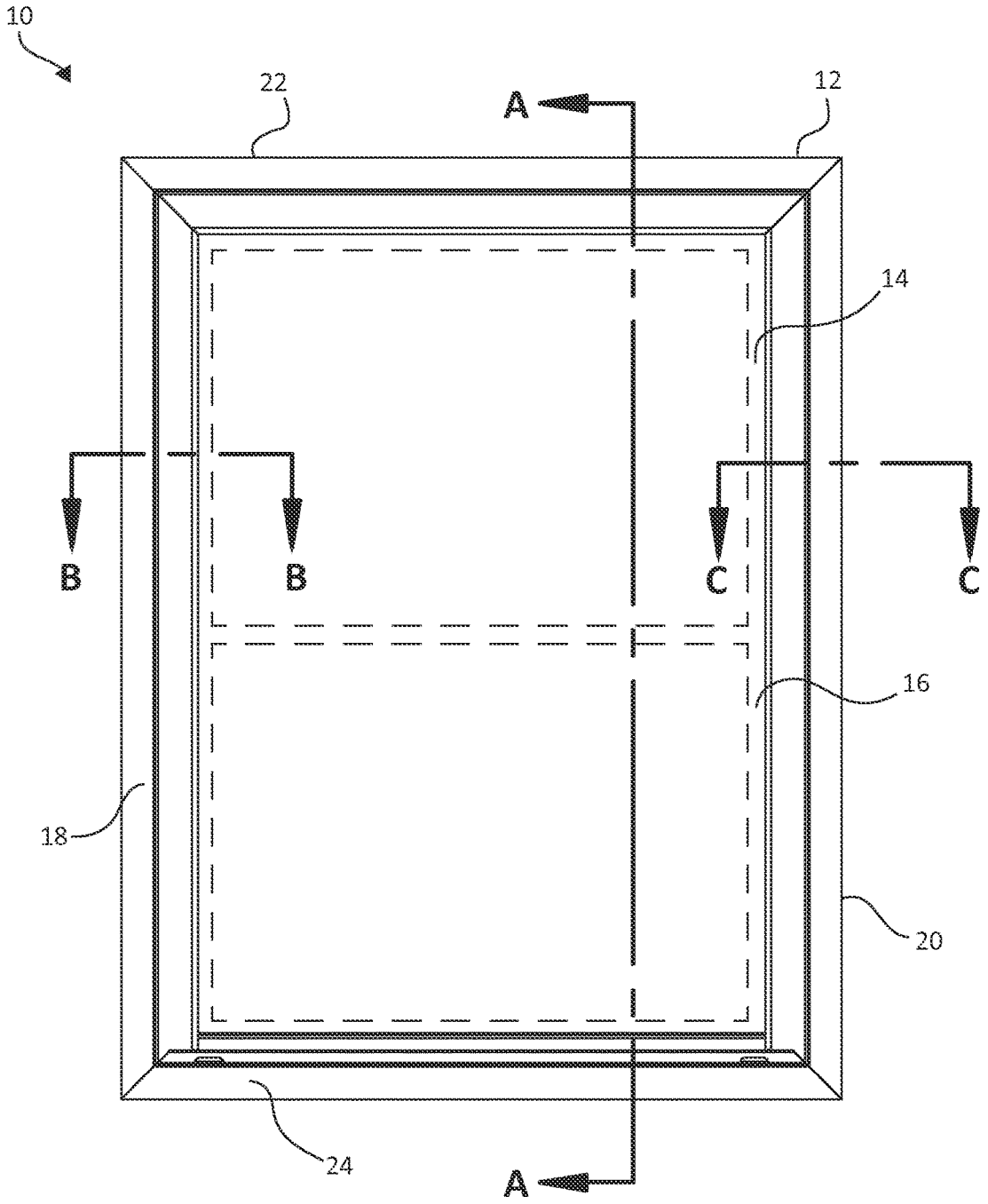
FIG. 1 is a front view of a fenestration unit in accordance with some embodiments of the invention.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

A fenestration unit, such as a window, having an upper sash and a lower sash can be configured to permit separate and independent movement of the upper sash and the lower sash when desired, while restraining the upper sash from movement caused by movement of the lower sash. Although embodiments including two movable sashes are addressed in greater detail below, other embodiments including a fenestration unit having a single movable sash configured to provide securement of the single movable sash against undesired vertical movement are also contemplated.

FIG. 1 is a front view of a fenestration unit 10. The fenestration unit 10 includes a frame 12, an upper sash 14 and a lower sash 16. While a single fenestration unit 10 is illustrated, it will be appreciated that multiple frames 12 can be joined together to form a larger fenestration unit 10. The frame 12 can be formed of any suitable material, such as fiberglass or vinyl. The upper and lower sashes 14, 16 are shown in FIG. 1 in phantom, so as to not overly complicate the subsequent cross-sectional views. The upper and lower sashes 14, 16 can be single, double or triple glazed units, for example, as desired.

The frame 12 includes a first side member 18 and a second side member 20. An upper member 22 extends across the top of the frame 12, from the first side member 18 to the second side member 20. A sill 24 extends across the bottom of the frame 12, from the first side member 18 to the second side member 20. In some embodiments, the upper sash 14 and the lower sash 16 are both vertically movable and/or are tiltable for cleaning. In some embodiments, the upper sash 14 is fixed in place, and the lower sash 16 is vertically movable and/or can be tilted for cleaning.

Figure 2:
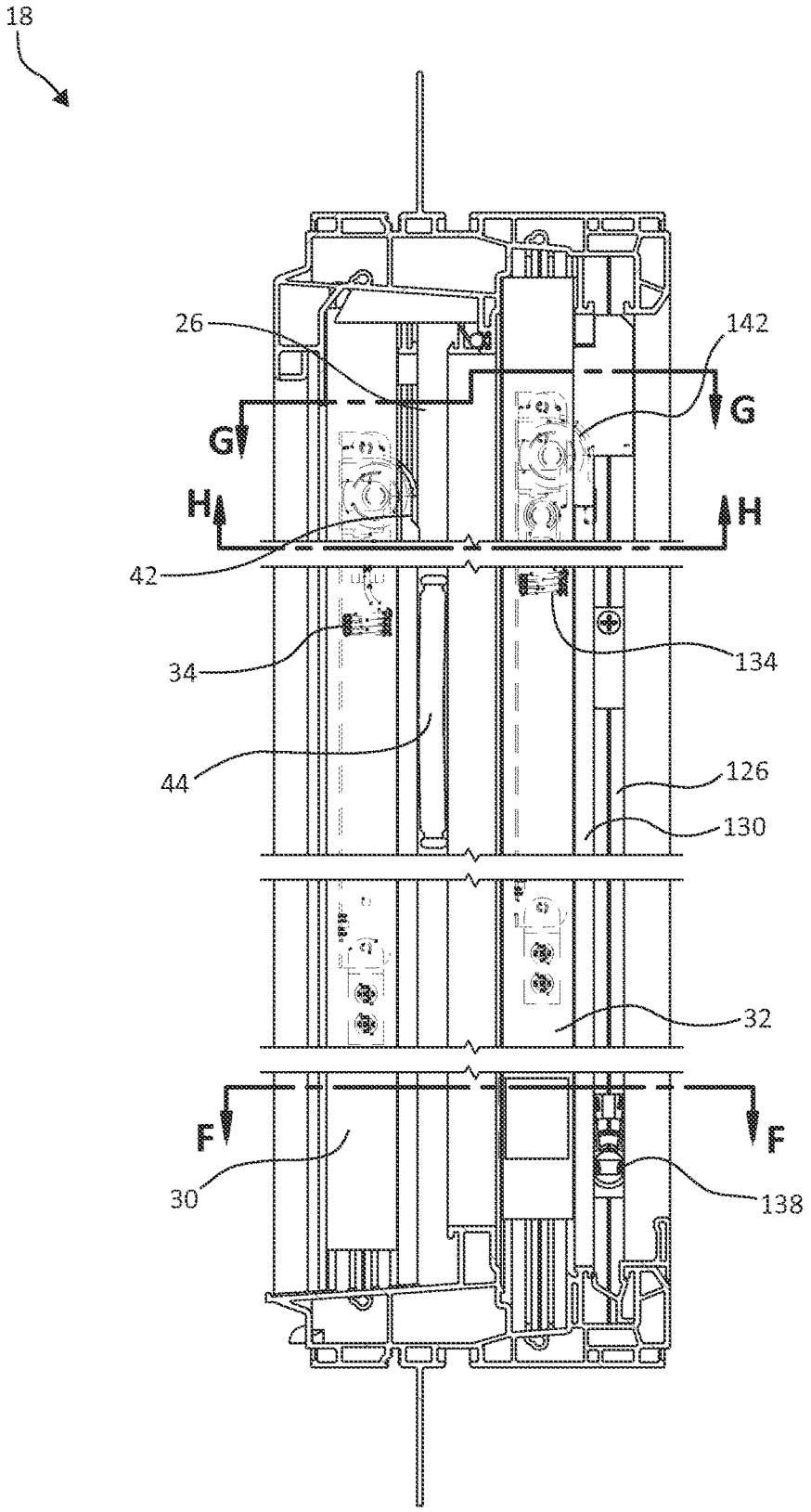
FIG. 2 is a sectional view of the fenestration unit of FIG. 1.
Figure 3A:
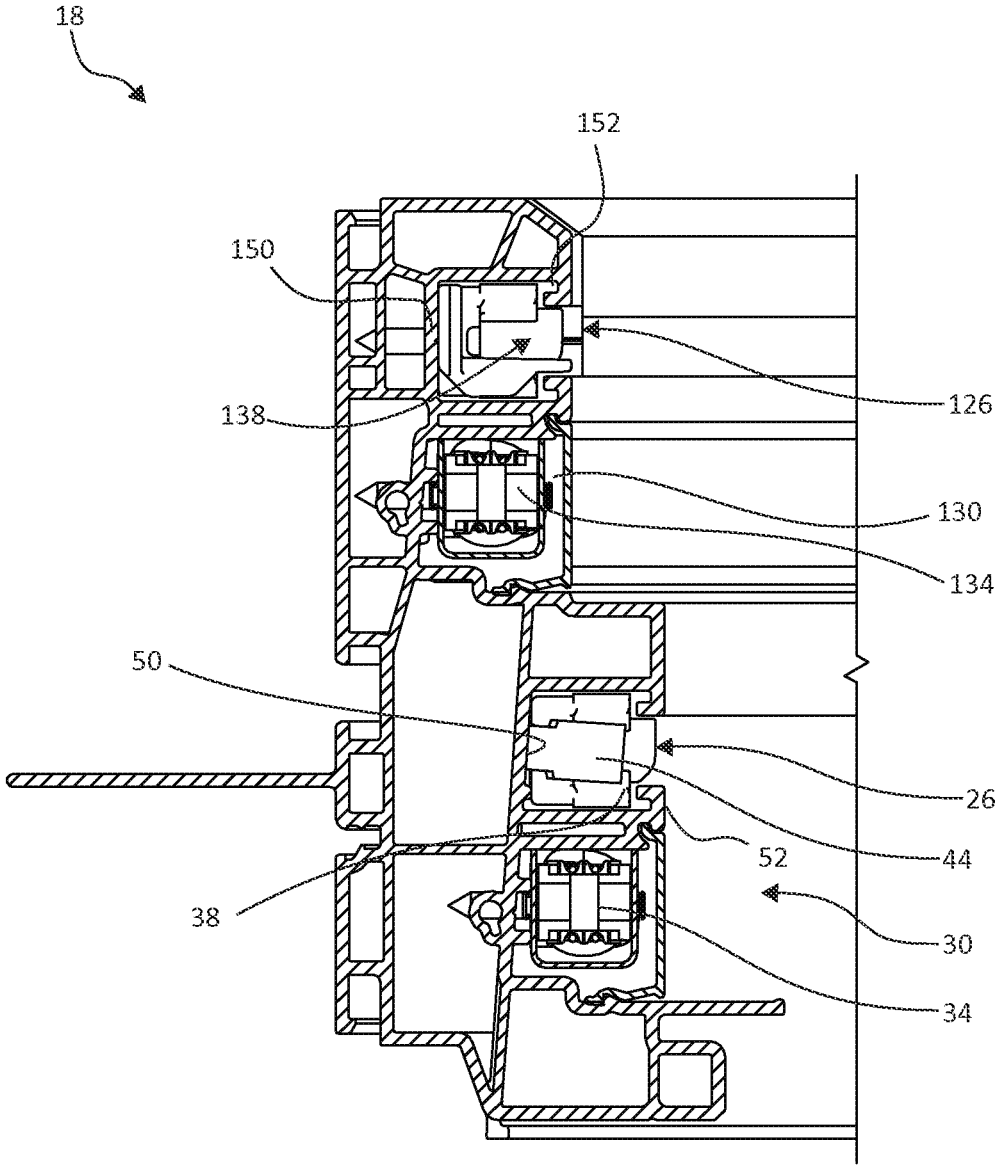
FIG. 3A is a sectional view of the fenestration unit of FIG. 1.
Figure 3B:
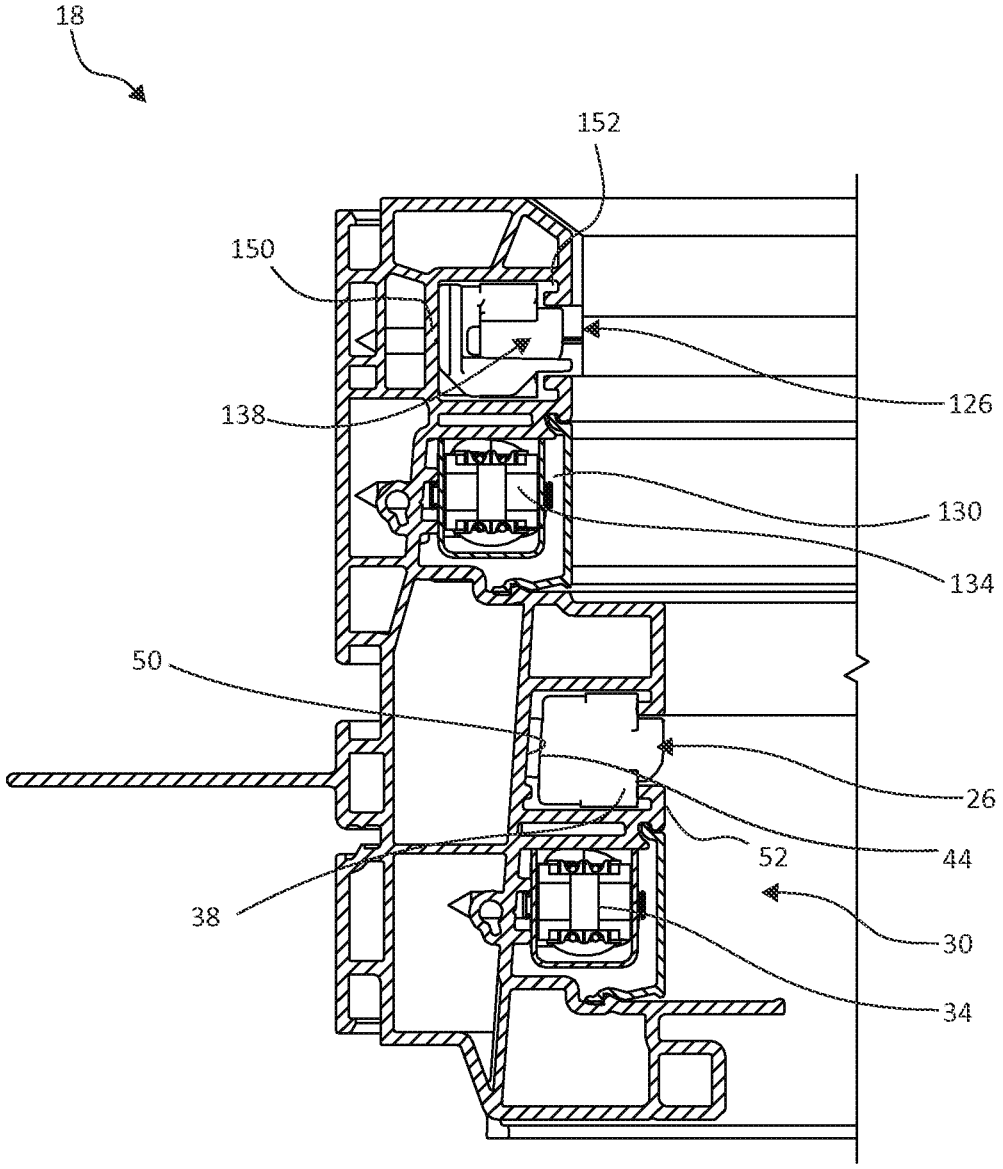
FIG. 3B is a sectional view of the fenestration unit of FIG. 1.
Figure 4:
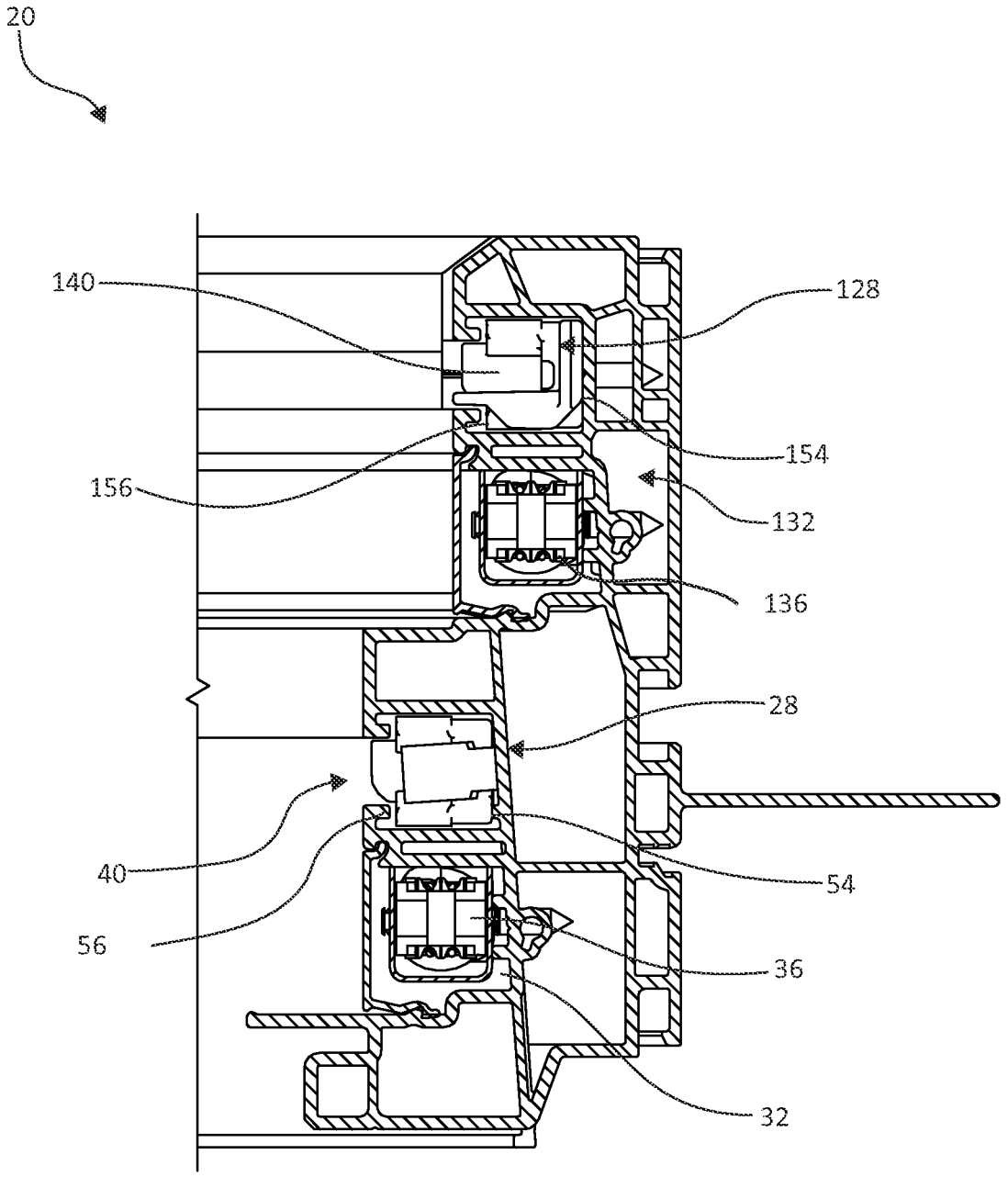
FIG. 4 is a sectional view of the fenestration unit of FIG. 1.

FIG. 2 is a cross-sectional view, taken along line A-A of FIG. 1 and FIG. 3A is a cross-sectional view, taken along line B-B of FIG. 1, of an inner side of the first side member 18 with the fenestration unit 10 in a first position. FIG. 3B is another cross-sectional view, taken along line B-B of FIG. 1 of the fenestration unit 10 in a second position. FIG. 4 is a cross-sectional view, taken along line C-C of FIG. 1, of an inner side of the second side member 20. The first side member 18 includes a first track 26 and the second side member 20 includes a second track 28. A first counterbalance channel 30 extends parallel to the first track 26 and a second counterbalance channel 32 extends parallel to the second track 28. A first counterbalance mechanism 34 is disposed proximate the first side member 18 and can be located within the first counterbalance channel 30. A second counterbalance mechanism 36 is disposed proximate the second side member 18 and can be located within the second counterbalance channel 32.

A first slide member 38 is slidingly disposed within the first track 26 and a second slide member 40 is slidingly disposed within the second track 28. In some embodiments, the first slide member 38 can be operably connected to the first counterbalance mechanism 34 by a cable or cord 42 extending from the first counterbalance mechanism 34. While not expressly illustrated, the second slide member 40 can be operably connected to the second counterbalance mechanism 36 in a similar fashion. It will be appreciated that the first counterbalance mechanism 34 and the second counterbalance mechanism 36 are configured to at least partially offset the weight of the upper sash 14.

The first slide member 38 and the second slide member 40 are configured to slide vertically within the first track 26 and the second track 28, respectively. The upper sash 14 is secured to the first slide member 38 and the second slide member 40 such that the upper sash 14 is able to move vertically (in the illustrated orientation) relative to the frame 12. In some embodiments, the first slide member 38 and the second slide member 40 are configured to permit the upper sash 14 to tilt or pivot relative to the frame 12 in order to facilitate cleaning.

The fenestration unit 10 includes a first resilient detent 44 that is secured to the first track 26. It will be appreciated that the first resilient detent 44 interacts with the first slide member 38 when the first slide member 38 is moved into position proximate the first resilient detent 44. For example, as shown in FIG. 3B, when moved into position the first slide member 38 engages the first resilient detent 44 to directly contact the detent 44. In some embodiments, this position corresponds to the upper sash 14 being in a raised or closed position. While not expressly illustrated, it will be appreciated that in some embodiments a second resilient detent is secured to the second track 128 (of the second side member 20) in a mirror image of the first resilient detent 44. In some embodiments, the fenestration unit 10 includes a single resilient detent (such as first resilient detent 44) that can be secured to either the first track 26 or the second track 28.

In some embodiments, the first track 26 can be considered as having a first outer surface 50 and a first inner retention lip 52. The first slide member 38 can be disposed between the first outer surface 50 and the first inner retention lip 52 such that the first resilient detent 44 pushes or urges the first slide member 38 towards the first inner retention lip 52 when the first resilient detent 44 interacts with the first slide member 38. Similarly, the second track 28 can be considered as having a second outer surface 54 and a second inner retention lip 56. The second slide member 40 can be disposed between the second outer surface 54 and the second inner retention lip 56 such that the second resilient detent pushes or urges the second slide member 40 towards the first inner retention lip 56 when the second resilient detent interacts with the second slide member 38.

As a result, the first resilient detent 44 and the second resilient detent can be considered as being configured to hold the upper sash 14 in position against inadvertent or incidental movement, such as when someone moves the lower sash 16, yet still permits an individual to move the upper sash 14 when they desire to do so by exceeding the frictional force exerted by the detent(s) on the sash(es). In some embodiments, the first resilient detent 44 is a first leaf spring and the second resilient detent is a second leaf spring. In some embodiments, the first and second leaf springs can vary in length, width or compressibility in order to accommodate sashes of varying size and weight. For example, a larger leaf spring can be used with a heavier sash.

Figure 5:
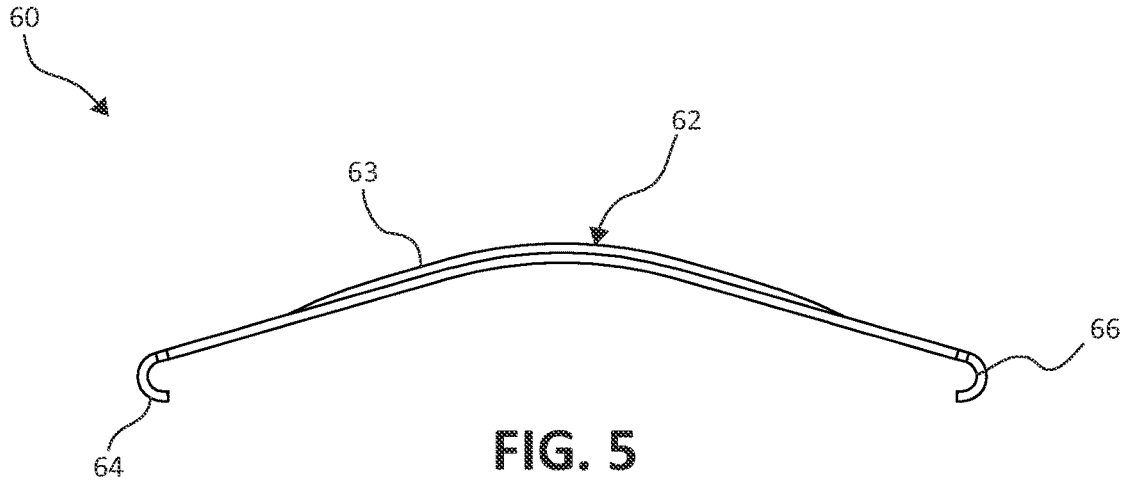
FIG. 5 is a side view of a spring clip useful in the fenestration unit of FIG. 1.

With reference to FIG. 5, the resilient detents can be a leaf spring 60 that has a bowed center portion 62 that is configured to interact with a corresponding sliding member 38, 40. In some embodiments, as shown, the bowed center portion 62 includes a narrowed portion 63 that facilitates interaction with a corresponding sliding member while limiting the frictional forces between the narrowed portion 63 and the corresponding sliding member such as the first sliding member 38 or the second sliding member 40. In some embodiments, the leaf spring 60 can be formed of spring steel.

In the illustrated embodiments, the leaf spring 60 has a first curved end 64 and a second curved end 66. The first and second curved ends 64, 66 are configured to fit into corresponding apertures formed in the first track 26 and the second track 28. It will be appreciated that in the illustrated embodiment, the compressive force provided when the leaf spring 60 interacts with a corresponding sliding member will function to push the first and second curved ends 64, 66 into a tighter grip on the apertures formed in the corresponding track. In other embodiments, the leaf spring 60 can be secured in any suitable fashion, including adhesives or mechanical fasteners. The configuration of either end of the leaf spring 60 can vary from that illustrated, depending on how the leaf spring 60 is being secured in place.

Thus far, various embodiments have been discussed with respect to the upper sash 14 and the hardware that facilitates movement and securement of the upper sash 14. The fenestration unit 10 also has a lower sash 16, and the fenestration unit 10 can be configured to also provide securement of the lower sash 16 against undesired movement, as shown in FIGS. 2-4.

Accordingly, in some embodiments, the frame 12 further includes a third track 126 disposed within the first side member 18 and a fourth track 128 disposed within the second side member 20. A third counterbalance channel 130 extends parallel to the third track 126 and a fourth counterbalance channel 132 extends parallel to the fourth track 128. A third counterbalance mechanism 134 is disposed proximate the first side member 18 and can be located within the third counterbalance channel 130. A fourth counterbalance mechanism 136 is disposed proximate the second side member 20 and can be located within the fourth counterbalance channel 132.

A third slide member 138 is slidingly disposed within the third track 126 and a fourth slide member 140 is slidingly disposed within the fourth track 128. In some embodiments, the third slide member 138 can be operably connected to the third counterbalance mechanism 134 by a cable or cord 142 extending from the third counterbalance mechanism 34. While not expressly illustrated, the fourth slide member 140 can be operably connected to the fourth counterbalance mechanism 136 in a similar fashion. It will be appreciated that the third counterbalance mechanism 134 and the fourth counterbalance mechanism 136 are configured to at least partially offset the weight of the lower sash 16.

The third slide member 138 and the fourth slide member 140 are configured to slide vertically within the third track 126 and the fourth track 128, respectively. The lower sash 16 is secured to the third slide member 138 and the fourth slide member 140 such that the lower sash 16 is able to move vertically (in the illustrated orientation) relative to the frame 12. In some embodiments, the third slide member 138 and the fourth slide member 140 are configured to permit the lower sash 16 to tilt or pivot relative to the frame 12 in order to facilitate cleaning.

In some embodiments, the fenestration unit 10 includes a third resilient detent (not visible) that is secured to the third track 126. It will be appreciated that the third resilient detent interacts with the third slide member 138 when the third slide member 138 is moved into position proximate the third resilient detent. In some embodiments, this position corresponds to the lower sash 16 being in a raised or open position. It will be appreciated that a fourth resilient detent is secured to the fourth track 128 (of the second side member 20).

In some embodiments, the third track 126 can be considered as having a third outer surface 150 and a third inner retention lip 152. The third slide member 138 can be disposed between the third outer surface 150 and the third inner retention lip 152 such that the third resilient detent pushes or urges the third slide member 138 towards the third inner retention lip 152 when the third resilient detent interacts with the third slide member 138.

Similarly, the fourth track 128 can be considered as having a fourth outer surface 154 and a fourth inner retention lip 156. The fourth slide member 140 can be disposed between the fourth outer surface 154 and the fourth inner retention lip 156 such that the fourth resilient detent pushes or urges the fourth slide member 140 towards the fourth inner retention lip 156 when the fourth resilient detent interacts with the fourth slide member 138.

As a result, the third resilient detent and the fourth resilient detent can be considered as being configured to hold the lower sash 16 in position against inadvertent or incidental movement, such as when someone moves the upper sash 14, yet still permits an individual to move the lower sash 16 when they desire to do so. In some embodiments, the third resilient detent and the fourth resilient detent are leaf springs, such as the leaf spring 60 shown in FIG. 5.

Figure 6:
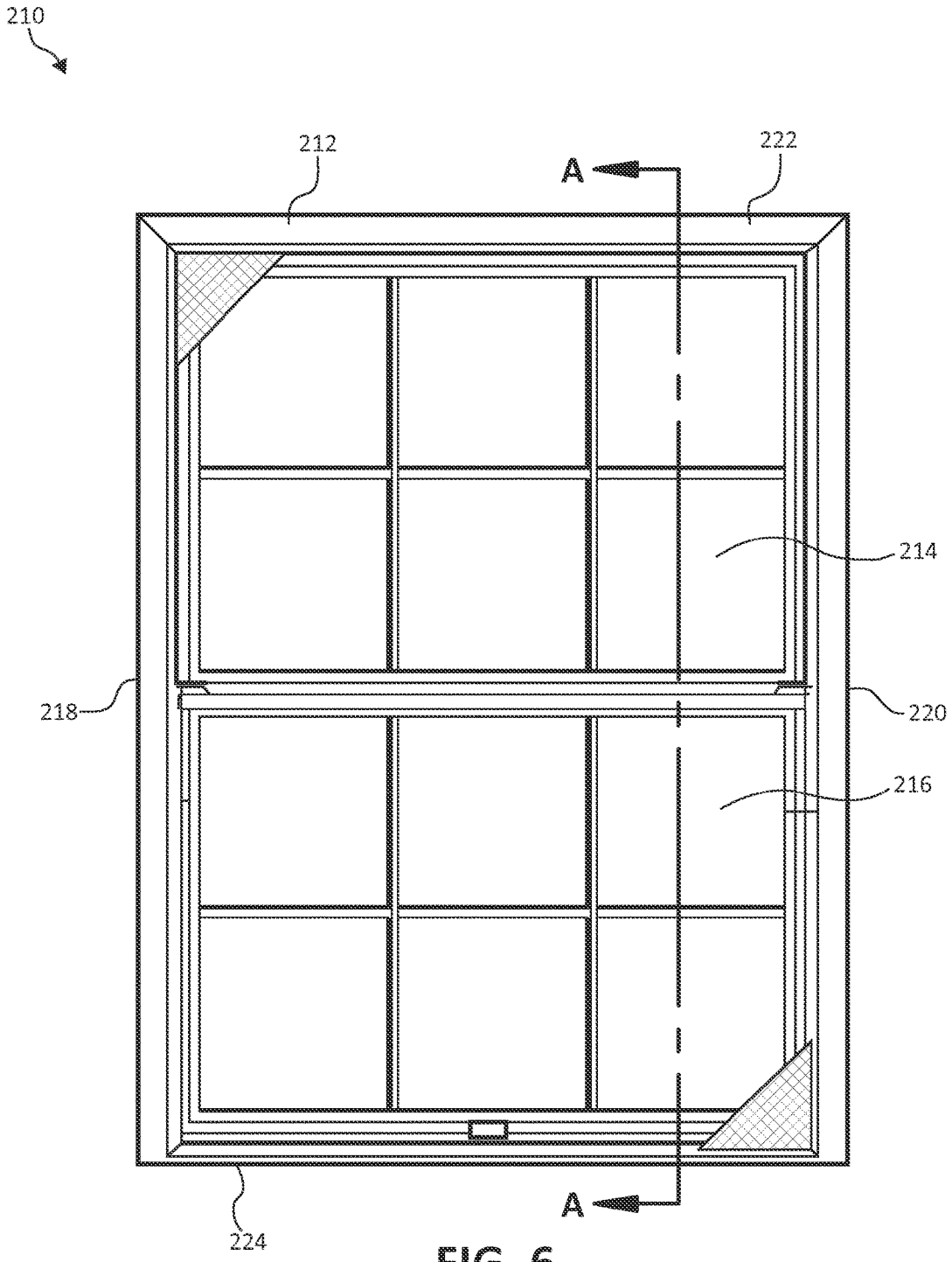
FIG. 6 is a front view of a fenestration unit in accordance with some embodiments of the invention.
Figure 7:
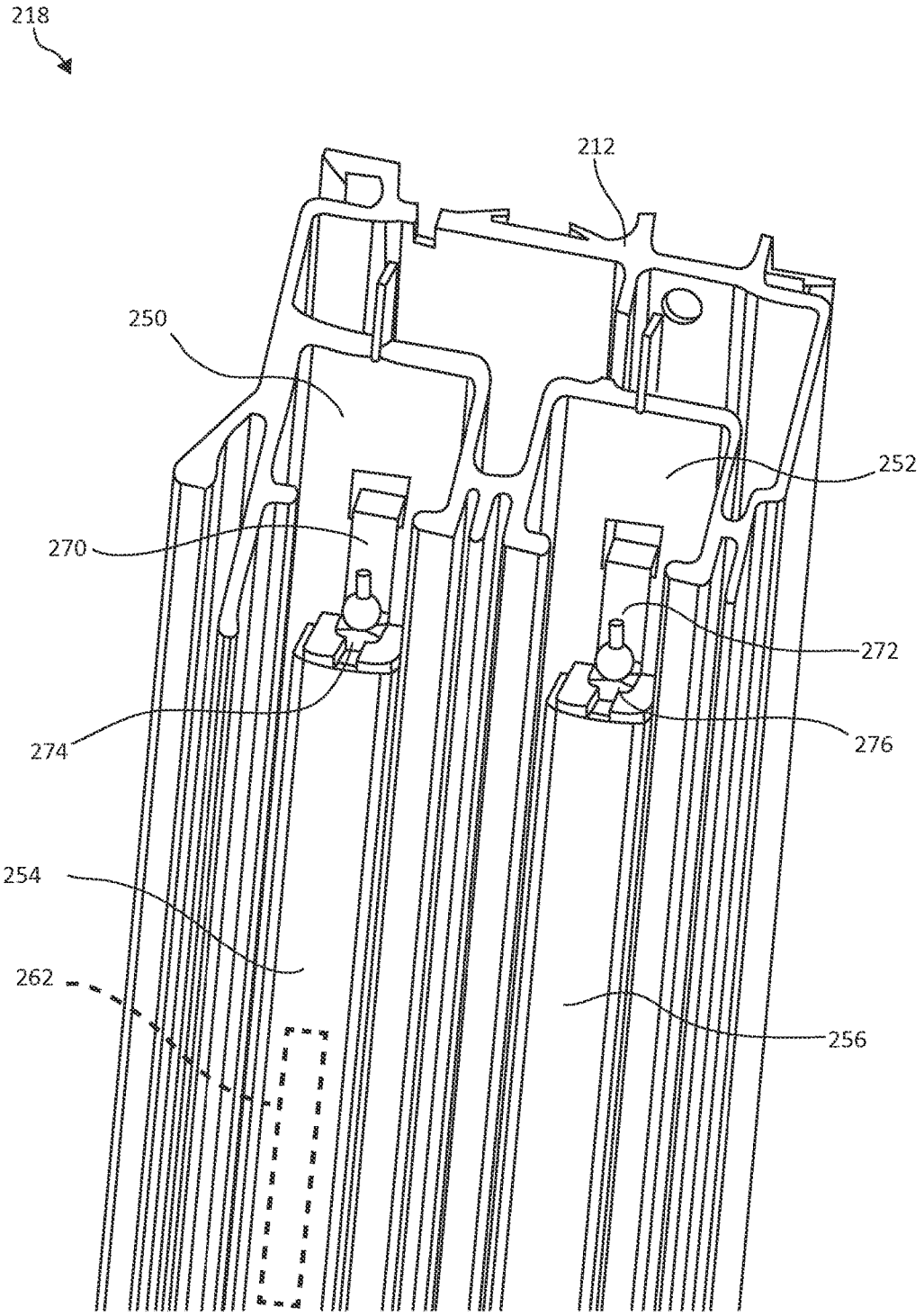
FIG. 7 is a sectional view of a portion of the fenestration unit of FIG. 6.
Figure 8:
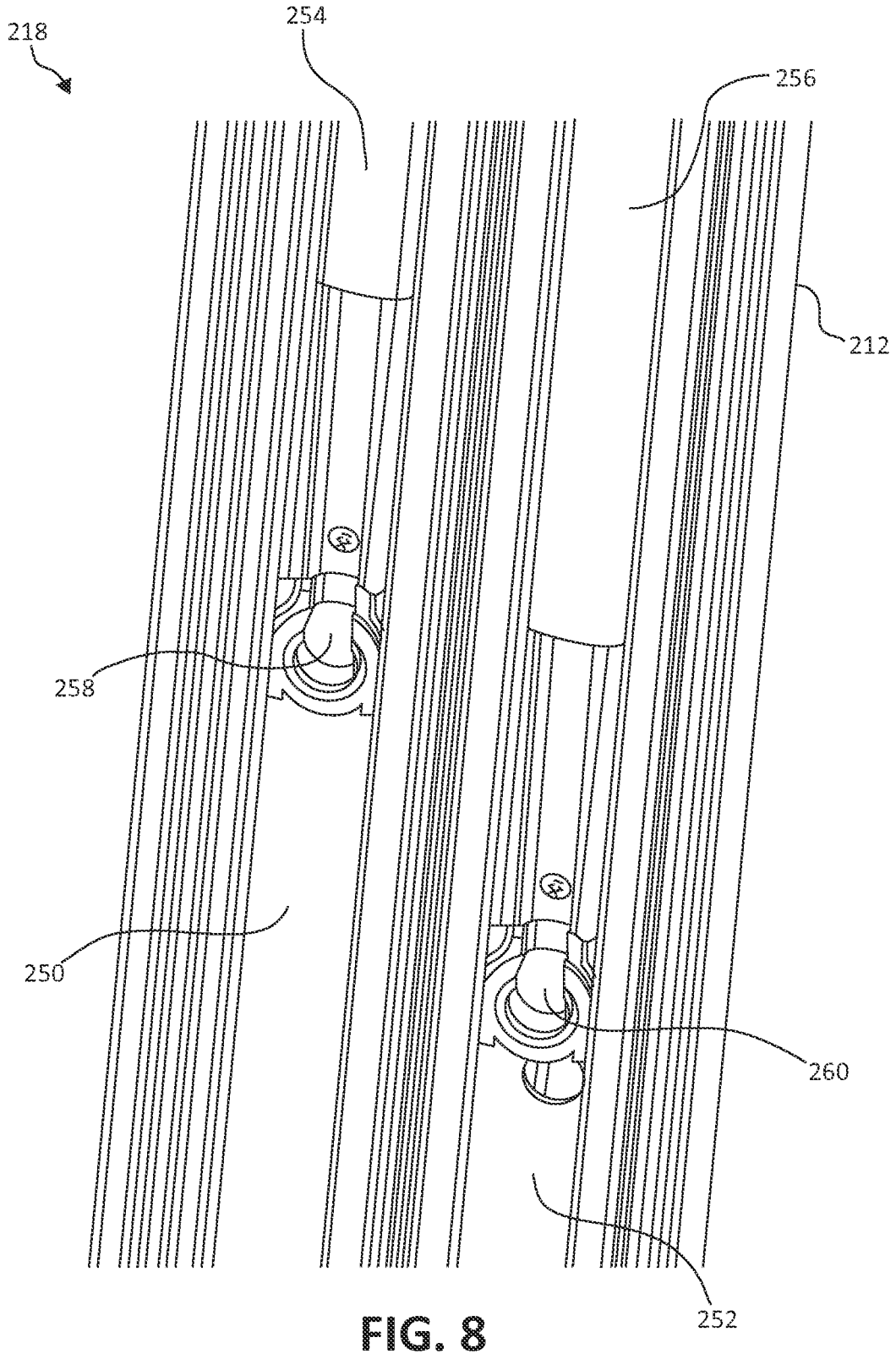
FIG. 8 is a sectional view of a portion of the fenestration unit of FIG. 6.

In the embodiments described thus far, the slide members and the counterbalance mechanisms are in separate tracks or channels. In some embodiments, the slide member and counterbalance mechanism are secured together and are located within a single track or channel and may both be secured to a lower sash or an upper sash. FIG. 6 is a front view of a fenestration unit 210 in which the slide member and counterbalance mechanism share a single track or channel. FIGS. 7 and 8 are cross-sectional views, taken along line A-A of FIG. 6, of portions of a side member of the fenestration unit 210.

The fenestration unit 210 includes a frame 212, an upper sash 214 and a lower sash 216. While a single fenestration unit 210 is illustrated, it will be appreciated that multiple frames 212 can be joined together to form a larger fenestration unit 210. The frame 212 can be formed of any suitable material, such as fiberglass or vinyl. The upper and lower sashes 214, 216 can be single, double or triple glazed units, for example, as desired.

The frame 212 includes a first side member 218 and a second side member 220. An upper member 222 extends across the top of the frame 212, from the first side member 218 to the second side member 220. A sill 224 extends across the bottom of the frame 212, from the first side member 218 to the second side member 220. In some embodiments, the upper sash 214 and the lower sash 216 are both vertically movable and/or are tiltable for cleaning. In some embodiments, the upper sash 214 is fixed in place, and the lower sash 216 is vertically movable and/or can be tilted for cleaning.

As illustrated in FIGS. 7 and 8, the first side member 218 includes a first channel 250 and a second channel 252. In some embodiments, the first channel 250 accommodates the hardware associated with the lower sash 216 while the second channel 252 accommodates the hardware associated with the upper sash 214. A first balance mechanism 254 is disposed within the first channel 250 and a second balance mechanism 256 is disposed within the second channel 252. A lower end of the first balance mechanism 254 includes a pivot point 258, which is where the lower sash 216 is pivotably attaches. A lower end of the second balance mechanism 256 includes a pivot point 260, which is where the upper sash 214 pivotably attaches. The first balance mechanism 254 and the second balance mechanism 256 move vertically with the sash to which they are attached. The balance mechanisms 254, 256, are attached to the first side member 218 via first and second clips 270, 272 and cables 274, 276, respectively. It will be appreciated that the second side member 220 includes corresponding hardware (not illustrated).

In some embodiments, the fenestration unit 210 can include at least one of a first resilient detent 262 (shown in broken lines hidden beneath the first balance mechanism 254) and a second resilient detent (not shown). The first resilient detent 262 and the second resilient detent are secured to the first channel 250 and the second channel 252, respectively. The first resilient detent 262, if present, is positioned to interact with the first balance mechanism 254 as the first balance mechanism 254 moves vertically into a position corresponding to the lower sash 216 reaching a fully open position, for example. The second resilient detent, if present, is positioned to interact with the second balance mechanism 256 as the second balance mechanism 256 moves vertically into a position corresponding to the upper sash 214 reaching a fully closed position. The resilient detents 262, 264, if present, can be leaf springs.

While various embodiments have been described, the scope of invention is intended to embrace all alternatives, modifications, and variations that fall within the scope of the claims, together with all equivalents thereof.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The following is claimed:

1. A fenestration unit comprising:

a frame including:

a first side member;

a first track disposed within the first side member;

a second side member; and a second track disposed within the second side member;

a first counterbalance mechanism disposed proximate the first side member;

a second counterbalance mechanism disposed proximate the second side member;

a first slide member slidably disposed within the first track and operably connected to the first counterbalance mechanism;

a second slide member slidingly disposed within the second track and operably connected to the second counterbalance mechanism;

a sash secured to the first slide member and the second slide member such that the sash is configured to move vertically relative to the frame;

one or more detents exerting frictional forces on the sash when the sash is in a closed position, the one or more detents including a first resilient detent secured to the first track, such that the first resilient detent directly engages the first slide member when the sash is in a fully closed position vertically within the frame, wherein the sash is configured to move vertically relative to the frame by exceeding the frictional forces exerted by the one or more detents on the sash.

2. The fenestration unit of claim 1, wherein the first resilient detent is secured to the first track such that the first resilient detent interacts with the first slide member when the sash is in a closed position.

3. The fenestration unit of claim 2, further comprising a second resilient detent secured to the second track such that the second resilient detent interacts with the second slide member when the sash is in the closed position.

4. The fenestration unit of claim 1, further comprising a first counterbalance channel extending parallel to the first track, the first counterbalance mechanism secured within the first counterbalance channel.

5. The fenestration unit of claim 1, further comprising a second counterbalance channel extending parallel to the second track, the second counterbalance mechanism secured within the second counterbalance channel.

6. The fenestration unit of claim 1, wherein the sash is pivotally secured to the first slide member and the second slide member such that the sash is configured to tilt relative to the frame.

7. The fenestration unit of claim 2, wherein the first track includes a first outer surface and a first inner retention lip, the first slide member disposed between the first outer surface and the first inner retention lip such that the first resilient detent pushes the first slide member towards the first inner retention lip when the first resilient detent interacts with the first slide member.

8. The fenestration unit of claim 3, wherein the second track includes a second outer surface and a second inner retention lip, the second slide member disposed between the second outer surface and the second inner retention lip such that the second resilient detent pushes the second slide member towards the second inner retention lip when the second resilient detent interacts with the second slide member.

9. The fenestration unit of claim 1, wherein the first resilient detent is configured to hold the sash in position against inadvertent or incidental movement, but permit intentional movement of the sash.

10. The fenestration unit of claim 1, wherein the first resilient detent comprises a leaf spring.

11. The fenestration unit of claim 3, wherein the second resilient detent comprises a leaf spring.

12. The fenestration unit of claim 1, wherein the sash comprises an upper sash, and the frame further comprises:

a third track disposed within the first side member; and a fourth track disposed within the second side member; and wherein the fenestration unit further comprises a lower sash disposed between the third track and the fourth track.

13. The fenestration unit of claim 12, further comprising:

a third slide member disposed within the third track; and a fourth slide member disposed within the fourth track;

wherein the lower sash is secured to the third slide member and the fourth slide member such that the lower sash is configured to move vertically relative to the frame.

14. A fenestration unit comprising:

a frame including a first side member and a second side member;

a first slide member slidingly disposed relative to the first side member;

a second slide member slidingly disposed relative to the second side member;

a sash disposed within the frame, the sash secured to the first slide member and the second slide member;

a first counterbalance apparatus configured to provide counterbalance to the sash, the first counterbalance apparatus disposed proximate the first side member;

a second counterbalance apparatus configured to provide counterbalance to the sash, the second counterbalance apparatus disposed proximate the second side member, and a plurality of detents exerting frictional forces on the sash when the sash is in a closed position, the plurality of detents including, a first detent configured to retain the sash in an upper position, the first detent disposed proximate a first track; and a second detent configured to retain the sash in the upper position, the second detent disposed proximate a second track;

wherein the first slide member directly engages the first detent and the second slide member directly engages the second detent when the sash is lifted into a raised position that is a fully closed position vertically within the frame such that the sash is configured to move vertically relative to the frame by exceeding the frictional forces exerted by the plurality of detents on the sash.

15. The fenestration unit of claim 14, wherein the first detent comprise a first spring clip secured to the first side member and the second detent comprise a second spring clip secured to the second side member.

* * * * *